US005482025A

United States Patent [19]

Finkel

[11] Patent Number: 5,482,025

[45] Date of Patent: Jan. 9, 1996

[54] ARROW SUPPORT FOR AN ARCHERY BOW

[76] Inventor: Bryan D. Finkel, P.O. Box 172, Rte. 626, Wake, Va. 23176

[21] Appl. No.: 380,728

[22] Filed: Jan. 30, 1995

[51] Int. Cl.[6] ..... F41B 5/22

[52] U.S. Cl. ..... 124/44.5

[58] Field of Search ..... 124/24.1, 44.5

[56] References Cited

U.S. PATENT DOCUMENTS

| | | | |
|---|---|---|---|
| 3,935,854 | 2/1976 | Troncoso | 124/44.5 |
| 4,332,232 | 6/1982 | Troncoso | 124/44.5 |
| 4,476,846 | 10/1984 | Carville | 124/44.5 |
| 4,827,895 | 5/1989 | Troncoso | 124/44.5 |
| 4,838,237 | 6/1989 | Cliburn | 124/44.5 |
| 5,062,407 | 11/1991 | Newbold | 124/44.5 |
| 5,070,855 | 12/1991 | Troncoso | 124/44.5 |
| 5,103,797 | 4/1992 | Newbold | 124/44.5 |
| 5,117,803 | 6/1992 | Johnson | 124/44.5 |
| 5,137,006 | 8/1992 | Gallops | 124/44.5 |
| 5,140,972 | 8/1992 | Fisk | 124/44.5 |
| 5,146,908 | 9/1992 | Larson | 124/88 |
| 5,205,267 | 4/1993 | Burdick | 124/24.1 |
| 5,261,383 | 11/1993 | Halamay | 124/44.5 |
| 5,285,764 | 2/1994 | Mertens | 124/44.5 |
| 5,383,441 | 1/1995 | Lightcap | 124/44.5 |

*Primary Examiner*—John A. Ricci
*Attorney, Agent, or Firm*—Norman B. Rainer

[57] ABSTRACT

An arrow rest device intended for attachment to a conventional archery bow includes a mounting panel connected to a base panel having a downwardly directed bifurcated extremity that defines a receiving slot. A threaded control rod having an axially oriented guide groove extends orthogonally through the slot, and threadably engages an adjustment wheel disposed partially within the slot. Upwardly directed arrow-supporting prongs are attached to one extremity of the control rod. A vertical adjustment plate secured to the control rod by way of engagement with the guide groove is slideably disposed against the base panel. Rotation of the wheel causes lateral movement of the control rod and prongs, and movement of the plate rotates the control rod to achieve elevational adjustment of the prongs.

8 Claims, 2 Drawing Sheets

ARROW SUPPORT FOR AN ARCHERY BOW

BACKGROUND OF THE INVENTION

1. Field of the Invention

The present invention generally relates to archery equipment, and more particularly concerns an improved arrow rest attachment for a bow.

2. Description of the Prior Art

Arrow rests for archery bows such as a compound bow usually includes a ledge connected to the sidewall of the bow in the so-called window of the bow above the bow shelf. The bow shelf defines the lower margin of the window, the latter being disposed in the handle or middle portion of the bow between the bow limbs and above the hand grip. The edge projects generally horizontally out into the window, and serves as a support for the arrow shaft so that it can be accurately aimed and shot from the bow. In order to shoot the arrow, its rear or nock end is seated or "nocked" upon the string, and the shaft is placed on and supported by the arrow rest ledge. The bowstring, which engages the limbs, is then drawn towards the archer, either with the fingers of one hand or with a mechanical release held by the hand or wrist, while the archer's other hand holds the bow at arms length in about vertical alignment. The drawing fingers, when used instead of a mechanical release, are usually protected by a finger tab or glove. When the string is fully drawn back, the arrow is aimed and then the string is released. The bent bow limbs force the released string and nocked arrow rapidly forward, the string reaches its forward limit of movement, and the arrow launches forward, free of the string and directed toward the target.

In moving forward from the string, the arrow vanes, attached adjacent the rear of the arrow shaft for stabilization of the arrow, usually clear a well constructed arrow rest ledge if the archer's fingers rather than a mechanical release have been used to draw the bow string. This is due to the phenomenon known as archers paradox. This phenomenon is characterized by a bowing or bending of the arrow shaft around the arrow rest ledge, and consequent clearing the vanes, due to the sudden propulsive force delivered by the string to the rear end of the arrow shaft in a plane other than along the exact longitudinal axis of the shaft. This misalignment of string force imparted to the arrow is caused by the side torque naturally given to the string as the string rolls or slides across the finger tab or glove fingers at an angle from the described plane during release of the string. During flight, the arrow so released goes through a series of diminishing alternate flexing and bowing motions, all of which tend to reduce its accuracy. Moreover, not all of the propulsive force possible is imparted by the string to the arrow, and arrow speed is consequently reduced.

In recent years, the described deficiencies have been largely overcome through the use of mechanical release aids. One type of such release aid usually comprises a hook of metal, plastic or the like which is held in the archer's hand, controlled by the fingers and features essentially point contact with the bow string, resulting in the latter being released more uniformly from shot to shot, and more in the plane along the longitudinal axis of the arrow. Essentially the same advantages are obtained with certain other types of mechanical releases, such as certain rope and strap releases. Consequently, more propulsive force is imparted to the arrow, it travels faster and more accurately, and archers paradox is substantially eliminated.

However, difficulties in having the arrow and its vanes clear the arrow rest ledge are usually encountered when using mechanical release aids because archers paradox has been largely eliminated. If a vane of the arrow strikes the ledge during the flight of the arrow, the vane rapidly becomes worn, does not properly stabilize the arrow, and must be replaced. Moreover, such striking causes the arrow to be pushed out of its direct trajectory and to be slowed down, resulting in reduced accuracy. The problem is most pronounced when relatively inflexible hard plastic vanes are used in place of feathers. Such hard vanes are weather resistant, more uniform and have less wind resistance than feathers, and so are most accurate. However, if any of them on the arrow touch the arrow rest ledge during flight of the arrow, the shot is pushed well off line and accuracy is sharply reduced.

Shaft positioning devices have been used to position the arrow shaft on the edge far enough away from the bow side wall and the main portion of the ledge to reduce the problem of vane interference. However, such devices must be adjustable to enable precise alignment of the shaft upon the forward-rearward axis of the bow. An arrow rest having horizontal and vertical adjustability is disclosed in FIG. 10 of U.S. Pat. No. 3,935,854 to Troncosco. However, said adjustability is not easily achieved, and the rest is not compatible with overdraw devices mountable upon the ledge for utilizing shorter arrows at a given length of draw of the drawstring.

It is accordingly an object of the present invention to provide an easily adjustable arrow rest for an archery bow.

It is another object of this invention to provide an arrow rest as in the foregoing object which does not contact the arrow vanes.

It is a further object of the present invention to provide an arrow rest of the aforesaid nature compatible with overdraw means on the same bow.

It is still another object of this invention to provide an arrow rest of the aforesaid nature which is easily installable upon a bow, and of durable construction amenable to low cost manufacture.

These and other beneficial objects and advantages will be apparent from the following description.

SUMMARY OF THE INVENTION

The above and other beneficial objects and advantages are accomplished in accordance with the present invention by an arrow rest device attachable to an archery bow above the ledge in the window thereof, said device comprising:

a) a substantially flat mounting panel having an interior surface directed toward said bow, and opposed exterior surface, b) a flat base panel connected to the interior surface of said mounting panel and coextensive therewith, said base panel defined in part by opposed interior and exterior surfaces, an upper edge, rearward edge, and a downwardly elongated bifurcated lower edge which defines a receiving slot centered within said base panel, c) a threaded control rod disposed orthogonally through said base panel and receiving slot and having an axially oriented straight guide recess and interior and exterior extremities, d) a pair of arrow-supporting prongs fixedly attached to and upwardly directed from said control rod, adjacent said interior extremity and having opposed arrow contacting tips at their uppermost extremities, e) a vertical adjustment plate slideably positioned against the exterior face of said base panel and having a lower extremity penetrated by said control rod, and an upper extremity provided with an arcuate retaining slot having interactive securing means for said plate, and a scale of markings, f) a horizontal adjustment wheel disposed partially within said receiving slot, the center of said wheel being threadably engaged with said control rod, and g) a set screw secured within said vertical adjustment plate coplanar relationship therewith and adapted to adjustably enter said guide recess, whereby h) said control rod and attached prongs can be moved horizontally by rotation of said wheel, and can be rotated axially, causing vertical adjustment of the arrow-contacting tips of said prongs.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

The expressions "interior" and "exterior" and terms of similar import refer to features facing toward or away from the bow, respectively.

DESCRIPTION OF THE PREFERRED EMBODIMENT

Figure 1:
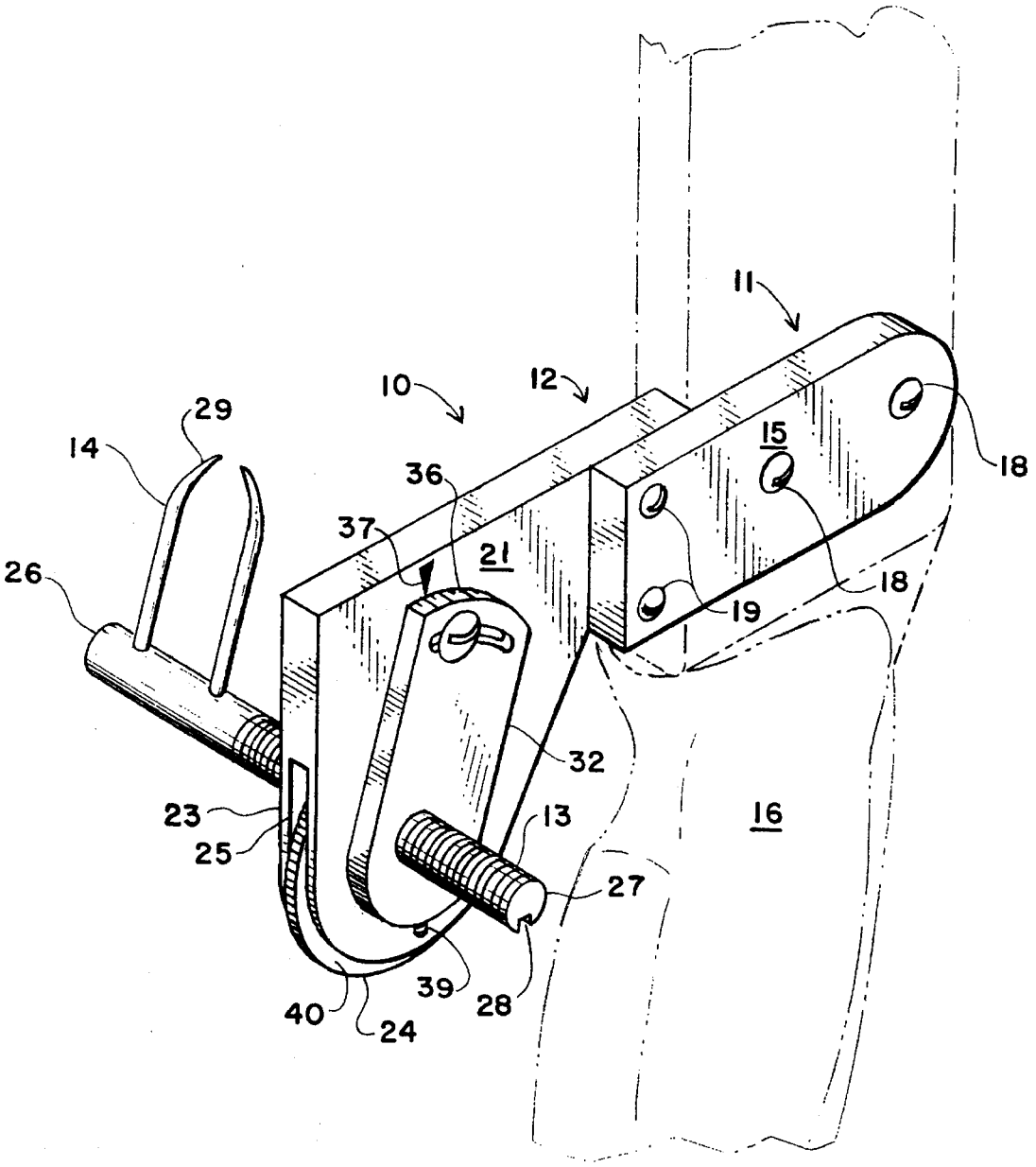
FIG. 1 is a perspective reap view of an embodiment of the arrow rest of the present invention.
Figure 2:
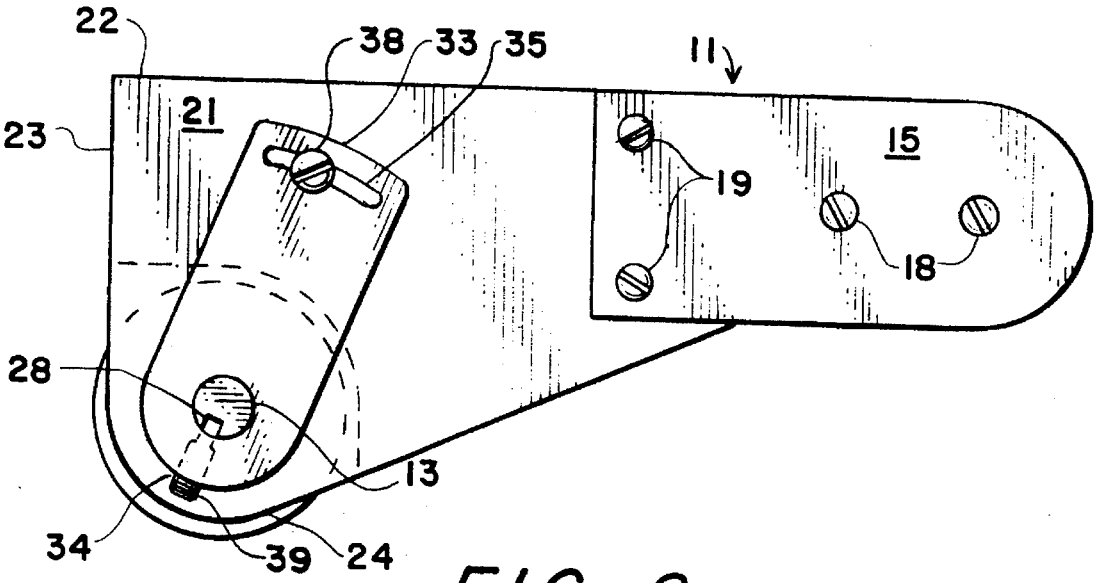
FIG. 2 is a side view of the embodiment of FIG. 1.
Figure 3:
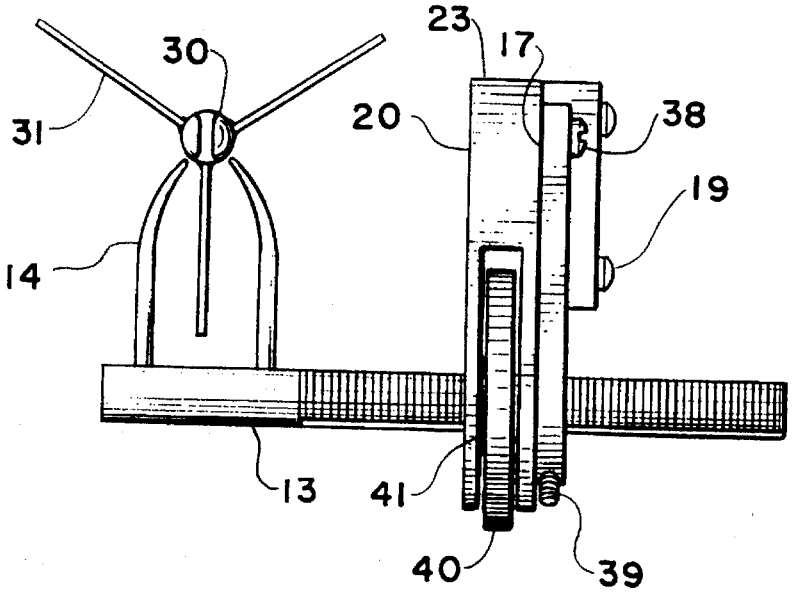
FIG. 3 is a rear view thereof shown in operative association with an arrow.

Referring to FIGS. 1–3, an embodiment of the arrow rest device 10 of the present invention is shown comprised of mounting panel 11, base panel 12, control rod 13 penetrating said base panel, and arrow-supporting prongs 14 upwardly emergent from rod 13.

Mounting panel 11 is defined by exterior flat surface 15 and opposed interior surface 17 adapted to abut against bow handle 16. Two mounting apertures 18 facilitate removable attachment by way of bolts to standard threaded recesses present in most bow handles.

Base panel 12 is joined by way of screws 19 to the interior surface of mounting panel 11 in a manner to be coextensive with said panel. Said base panel is defined in part by opposed interior and exterior surfaces, 20 and 21, respectively, upper edge 22, rearward edge 23 and bifurcated arcuate lower edge 24. A receiving slot 25 centered within said base panel and coplanar therewith is disposed in the region of joinder of rearward edge 23 with lower edge 24.

Threaded control rod 13, having interior and exterior extremities 26 and 27, respectively, orthogonally and slideably penetrates said base panel and receiving slot 25. The control rod has an axially oriented straight guide recess 28 disposed upon its underside.

A pair of arrow-supporting prongs 14 are fixedly attached to rod 13 adjacent the extremity 26 thereof, and extend generally upward therefrom. The prongs have opposed arrow-contacting tips 29 at their uppermost extremities. Said tips and prongs are adapted to engage an arrow 30, as shown in FIG. 3, in a manner such that arrow vanes 31 do not contact the prongs or any other parts of the device or bow.

A vertical adjustment plate 32 having upper and lower extremities 33 and 34, respectively, is slideably positioned against exterior surface 21 of base panel 12. Lower extremity 34 is slideably and orthogonally penetrated by control rod 13. Upper extremity 33 is provided with arcuate retaining slot 35 and a scale of markings 36 interactive with a fixed mark 37 on exterior surface 21 of said base panel. Securing means, in the form of bolt 38 threadably engaging said base panel, permits adjustment plate 32 to be immobilized against said base panel in any desired position of pivotal movement about rod 13.

A set screw 39 is secured within adjustment plate 32 and adapted to removably enter the guide recess 28 in control rod 13. When said set screw engages said recess, movement of adjustment plate 32 causes rotation of said control rod about its long axis. Such rotational movement causes change in the elevation of arrow-holding tips 29 and any arrow resting thereupon.

A horizontal adjustment wheel 40 is disposed partially within said receiving slot, the center of said wheel threadably engaging said control rod. By virtue of such construction, rotation of wheel 40 causes displacement of control rod 13 with prongs 14 laterally toward and away from the bow. Resilient space-occupying means such as a circular wave spring 41 or plastic foam material may be disposed within said receiving slot in abutment with wheel 40 and the receiving slot for the purpose of minimizing vibration and stabilizing the wheel against unwanted rotation. Accordingly, the aforesaid components and their interaction enable an archer to position the arrow exactly on the forward-rearward axis of the bow, while overcoming the shortcomings of earlier arrow rest devices.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An arrow rest device attachable to a conventional archery bow above the ledge of the window thereof, said device comprising:

a) a substantially flat mounting panel having an interior surface directed toward said bow, and opposed exterior surface, b) a flat base panel connected to said mounting panel and coextensive therewith, said base panel defined in part by opposed interior and exterior surfaces, an upper edge, rearward edge, and a bifurcated lower edge which defines a receiving slot centered within said base panel, c) a threaded control rod disposed orthogonally through said base panel and receiving slot and having an axially oriented straight guide recess and interior and exterior extremities, d) a pair of arrow-supporting prongs fixedly attached to and upwardly directed from said control rod adjacent said interior extremity and having opposed arrow contacting tips at their uppermost extremities, e) a vertical adjustment plate slideably positioned against the exterior face of said base panel and having a lower extremity penetrated by said control rod, and an upper extremity provided with an arcuate retaining slot having interactive securing means for said plate, f) an adjustment wheel disposed partially within said receiving slot, the center of said wheel being threadably engaged with said control rod, and g) means secured within said vertical adjustment plate for adjustably entering said guide recess, whereby h) said control rod and attached prongs can be moved horizontally by rotation of said wheel, and can be rotated axially, causing vertical adjustment of said prongs.

2. The device of claim 1 wherein a scale of markings is associated with the upper extremity of said vertical adjustment plate.

3. The device of claim 2 wherein the upper extremity of said vertical adjustment plate is of arcuate shape concave with respect to said control rod.

4. The device of claim 3 wherein said mounting panel contains mounting apertures.

5. The device of claim 4 wherein said receiving slot is located in a region of joinder of said rearward edge with said lower edge.

6. The device of claim 5 wherein said guide recess is disposed upon the underside of said control rod.

7. The device of claim 1 wherein said securing means is a bolt that penetrates said retaining slot and threadably engages said base panel.

8. The device of claim 1 wherein resilient space-occupying means is disposed within said receiving slot in abutment between said wheel and said base panel for the purpose of minimizing vibration and preventing unwanted rotation of said wheel.

* * * * *